US007789474B2

(12) United States Patent
Seki et al.

(10) Patent No.: US 7,789,474 B2
(45) Date of Patent: Sep. 7, 2010

(54) INKJET PRINTING APPARATUS AND METHOD FOR CALCULATING INK CONSUMPTION

(75) Inventors: Satoshi Seki, Kawasaki (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/957,796

(22) Filed: Dec. 17, 2007

(65) Prior Publication Data

US 2008/0150973 A1 Jun. 26, 2008

(30) Foreign Application Priority Data

Dec. 21, 2006 (JP) ..... 2006-344633

(51) Int. Cl.
*B41J 2/195* (2006.01)
*B41J 2/165* (2006.01)

(52) U.S. Cl. ..... 347/7; 347/30

(58) Field of Classification Search ..... 347/7
See application file for complete search history.

(56) References Cited

U.S. PATENT DOCUMENTS 5,519,418 A 5/1996 Nishikawa et al.
5,663,750 A * 9/1997 Sakuma ..... 347/7
6,000,778 A 12/1999 Koitabashi et al. ..... 347/23
6,145,956 A 11/2000 Koitabashi et al. ..... 347/30
6,149,261 A 11/2000 Kuwabara et al. ..... 347/30
6,227,642 B1 * 5/2001 Hanabusa et al. ..... 347/19
2005/0046650 A1 3/2005 Moriyama et al.
2005/0174382 A1 8/2005 Yoshikawa et al. ..... 347/30
2005/0275681 A1 12/2005 Nakagawa et al. ..... 347/30
2006/0221121 A1 10/2006 Ide et al. ..... 347/29
2007/0291075 A1 12/2007 Mizoguchi et al. ..... 347/37

FOREIGN PATENT DOCUMENTS

JP 59-194853 11/1984
JP 6-126981 5/1994
JP 2005-053110 3/2005

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

An inkjet printing apparatus and a method for calculating an ink consumption that can reduce a difference between an ink consumption recognized by the printing apparatus and a consumption of ink actually consumed are provided. For this, at the time of calculation of an ink consumption by the printing apparatus, a suction amount rank indicating the quantity of a suction amount due to an individual difference in the apparatus is used to correct the suction amount, whereby the difference between an ink consumption recognized by the printing apparatus and a consumption of ink actually consumed is reduce.

2 Claims, 18 Drawing Sheets

| | RANK 1 | RANK 2 | RANK 3 |
|---|---|---|---|
| SUCTION A | 0.45 | 0.50 | 0.55 |
| SUCTION B | 0.68 | 0.75 | 0.83 |
| SUCTION C | 0.90 | 1.00 | 1.10 |
| SUCTION D | 1.08 | 1.20 | 1.32 |

FIG.11

| | RANK 1 | RANK 2 | RANK 3 | RANK 4 | RANK 5 | RANK 6 | RANK 7 | RANK 8 | RANK 9 |
|---|---|---|---|---|---|---|---|---|---|
| JET AMOUNT | 3.2 | 3.3 | 3.4 | 3.5 | 3.6 | 3.7 | 3.8 | 3.9 | 4 |

FIG.12

| | THead < Th1 | Th1 < THead < Th2 | THead > Th2 |
|---|---|---|---|
| CORRECTION VALUE K | -4 | 0 | +4 |

FIG.16

| | Te < Th1 | Th1 < Te < Th2 | Te > Th2 |
|---|---|---|---|
| CORRECTION VALUE L | -1 | 0 | +1 |

FIG.17

INKJET PRINTING APPARATUS AND METHOD FOR CALCULATING INK CONSUMPTION

BACKGROUND OF THE INVENTION

1. Field of the Invention

The present invention relates to an inkjet printing apparatus that carries out printing by ejecting ink, and more particularly, to an inkjet printing apparatus that is capable of calculating ink consumption and a method for calculating ink consumption.

2. Description of the Related Art

For estimating the residual amount of ink in an ink tank, it has been known to calculate ink consumption by a dot counting method (see Japanese Patent Laid-Open No. 2005-53110 and Japanese Patent Laid-Open No. 6-126981). This dot counting method is a method for calculating a consumed ink amount by predetermining an amount of ink per one time of ejecting (1 dot) and checking how many times ejecting has been performed, and multiplying this number of times of ejecting by the abovementioned predetermined amount.

Meanwhile, for the purpose of maintaining printing by a printing head in a satisfactory state, a process to recover an ejecting state of the printing head by suction has been generally performed. The ink in an ink tank is consumed also by this recovery process. Conventionally, in this recovery process as well, employed is a method for recognizing ink consumption, in the same manner as the dot counting method, by predetermining a fixed ink amount to be consumed by one time of recovery operation and checking by a printing apparatus the number of times the recovery process has been performed. For example, in Japanese Patent Laid-Open No. 59-194853 (Japanese Patent No. 1814569), it has been disclosed to calculate a total consumption of ink consumed in a printing apparatus by summation of the consumption of ink consumed by a recovery operation and the consumption of ink consumed by an ejecting operation as described above. Also, in the following, not only the method for recognizing an ink consumption by an ejecting operation but also this method for recognizing an ink consumption by a sucking operation are called a "dot counting method."

However, in the conventional residual ink amount detection by a dot counting method, since an ink consumption corresponding to one time of ejecting or one time of sucking operation has been fixed regardless of individual differences in devices, a relatively large error has sometimes occurred in an ink consumption finally calculated. That is, a relatively large difference occurs between an ink consumption calculated by an operation and an actual ink consumption. When such a difference occurs, the apparatus judges that the residual ink amount has become "0" or a predetermined amount or less although sufficient ink actually remains.

Therefore, the present inventors have keenly examined the causes for an error in the ink consumption calculated as mentioned above. First, as the main cause of a fluctuation in the ink consumption, a fluctuation in the ejecting amount due to individual differences in printing heads, a fluctuation in the suction amount due to individual differences in suction unit (suction pumps), and a fluctuation in the injection amount of ink into the ink tank have been considered. And, as a result of a study on the consumption of ink when an ordinary user has actually carried out printing, the following findings on the fluctuation were obtained.

Here, for conducting the study, the consumption is calculated on the premise of a case where an ordinary user normally used a printing apparatus equipped with an ink tank with an ink capacity of 14 g, that is, performed intermittent printing including discontinuing by use of the printing medium. As concrete numerical values, the number of dots printed per one day with one type of ink is 65.7 million dots, the maximum ejection amount in one dot is 4 ng, the minimum ejection amount is 3.5 ng, the number of times of suction performed per one day for a printing recovery is 12 times, the maximum suction amount is 0.56 g, and the minimum suction amount is 0.5 g.

In addition, as a formula for calculation, the following is used:

Ink consumption in ink tank=(ejection amount×number of dots used)+(ink consumption at the time of cleaning the printing head×number of times of suction) (Expression 1)

When the ink consumption is calculated for the abovementioned conditions, it is determined that the ink in the ink tank is used up by performing printing for 27 days.

FIG. 10 is a view showing an amount of ink (remaining ink) actually remaining in the ink tank when the ink consumption was calculated for the abovementioned conditions and the residual amount in the ink tank was consequently recognized as "0" by cause for that error. Concretely, this is a ratio of error factors when printing and a suction recovery were actually performed at a minimum value of the ejecting amount and a minimum value of the suction amount although a calculation of the ink consumption was performed with the ejecting amount set as a maximum value, and the suction amount, as a maximum value, shown by a graph. As can be understood from FIG. 10, in fact, about a half (47)% of the remaining ink corresponding to an error is due to a fluctuation in the suction amount, and reducing this fluctuation in the suction amount is effective in reducing the error in the ink consumption due to an operation. In addition, by taking into consideration a fluctuation in the ejecting amount besides this fluctuation in the suction amount, the ink consumption calculated by an operation can be further approximated to actual ink consumption.

SUMMARY OF THE INVENTION

Therefore, it is an object of the present invention to reduce a difference between an ink consumption according to an operation and an actual ink consumption by calculating a more accurate ink consumption when calculating an ejecting amount from a printing head and a suction amount for a recovery of the printing head.

According to a first aspect of the invention, there is provided an inkjet printing apparatus that performs printing by use of a printing head that discharges ink, comprising: a sucking unit for performing a sucking operation to suck ink from the printing head; an obtaining unit for obtaining suction amount rank information, which is information on quantity of a suction amount due to an individual difference in the inkjet printing apparatus having been ranked, corresponding to a suction amount unique to the inkjet printing apparatus; and a consumption calculating unit for calculating, based on suction amount rank information obtained by the obtaining unit, a consumption of ink consumed by a sucking operation by the sucking unit.

According to a first aspect of the invention, there is provided an inkjet printing apparatus that performs printing by use of a printing head that discharges ink, comprising: a sucking unit for performing a sucking operation to suck ink from the printing head; an obtaining unit for obtaining suction amount rank information, which is information on quantity of a suction amount due to an individual difference in the inkjet printing apparatus having been ranked, corresponding to a suction amount unique to the inkjet printing apparatus and ejecting amount rank information, which is information on quantity of an ejecting amount due to an individual difference in the printing head having been ranked, corresponding to an ejecting amount unique to the printing head; and a consumption calculating unit for calculating a total consumption of ink consumed by the inkjet printing apparatus by a sum of a consumption of ink consumed by a sucking operation by the sucking unit, calculated based on suction amount rank information obtained by the obtaining unit and a consumption of ink consumed by an ejecting operation by the printing head, calculated based on ejecting amount rank information obtained by the obtaining unit.

According to a first aspect of the invention, there is provided a method for calculating an ink consumption of an inkjet printing apparatus including a sucking unit for performing a sucking operation to suck ink from a printing head for ejecting ink, comprising the steps of: obtaining suction amount rank information corresponding to a suction amount unique to the inkjet printing apparatus and ejecting amount rank information corresponding to an ejecting amount unique to the printing head; and calculating a total consumption of ink consumed by the inkjet printing apparatus by a sum of a consumption of ink consumed by a sucking operation by the sucking unit, calculated based on the obtained suction amount rank information and a consumption of ink consumed by an ejecting operation by the printing head, calculated based on the obtained ejecting amount rank information by the obtaining unit.

According to the present invention, when calculating ink consumption of an inkjet printing apparatus, the ink consumption is calculated based on a suction amount rank unique to the printing apparatus. Thereby, the difference between an ink consumption according to an operation and an actual ink consumption can be reduced.

Further features of the present invention will become apparent from the following description of exemplary embodiments (with reference to the attached drawings).

BRIEF DESCRIPTION OF THE DRAWINGS

FIG. 11 is a table showing a relationship between the suction amount rank and suction amount used in the first embodiment;

FIG. 12 is a table showing a relationship between the ejecting amount rank and ejecting amount used in the second embodiment;

FIG. 16 is a correction table showing an example of a relationship between the head temperature and correction value of the ejecting amount used in the third embodiment;

FIG. 17 is a correction table showing an example of a relationship between the environmental temperature and correction value of the suction amount used in the third embodiment;

DESCRIPTION OF THE EMBODIMENTS

First Embodiment

Figure 1:
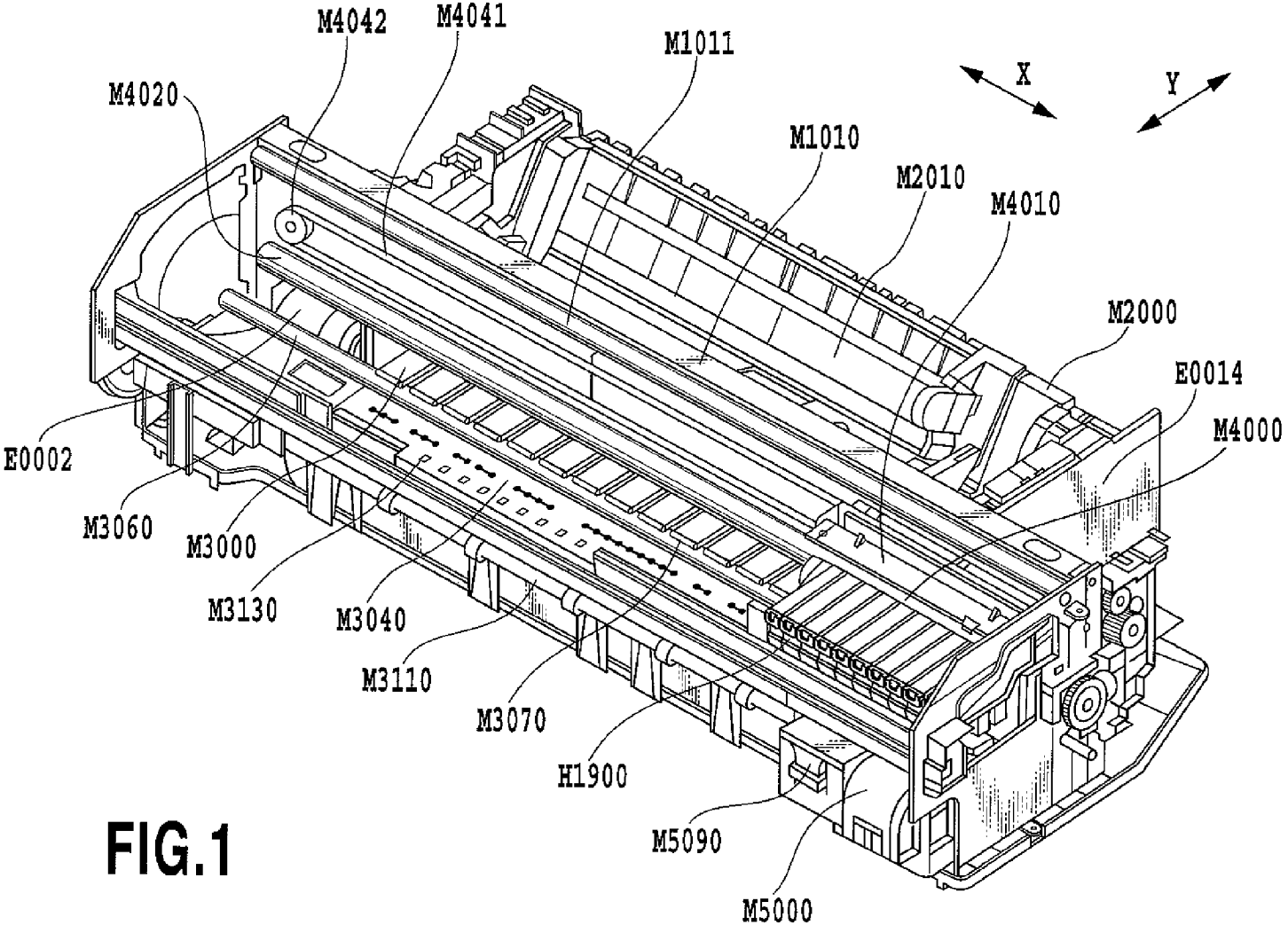
FIG. 1 is a perspective view of an inkjet printing apparatus in an embodiment of the present invention.

Hereinafter, a first embodiment of the present invention will be described in detail with reference to the drawings.

1. Basic Configuration (Configuration of Mechanism Portions)

A configuration of the respective mechanism portions in a printing apparatus applied in the present embodiment will be described. A printing unit body of the present embodiment can be generally divided, according to roles of the respective mechanism portions, into a paper feeding portion, a sheet conveying portion, a paper ejecting portion, a carriage portion, a flat-pass printing portion, and a cleaning portion, and these are stored in an outer package portion.

Hereinafter, description will be given of these mechanism portions while referring to the drawings as appropriate.

Figure 2:
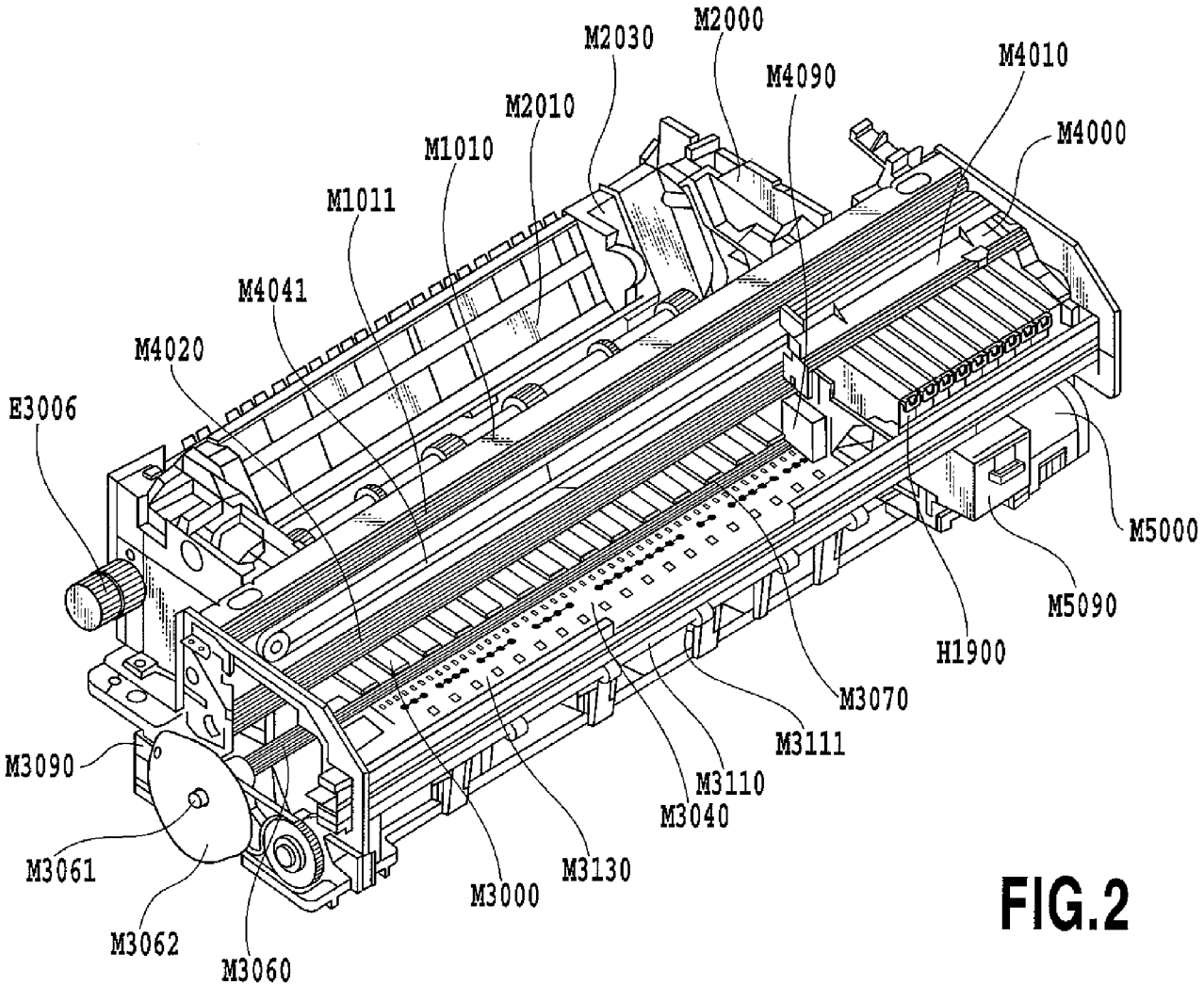
FIG. 2 is a perspective view of the inkjet printing apparatus in the embodiment of the present invention.

FIG. 1 is a perspective view from above on one side of an inkjet printing apparatus to which the present invention can be applied, and FIG. 2 is a perspective view from above on the other side of the same inkjet printing apparatus.

Figure 3:
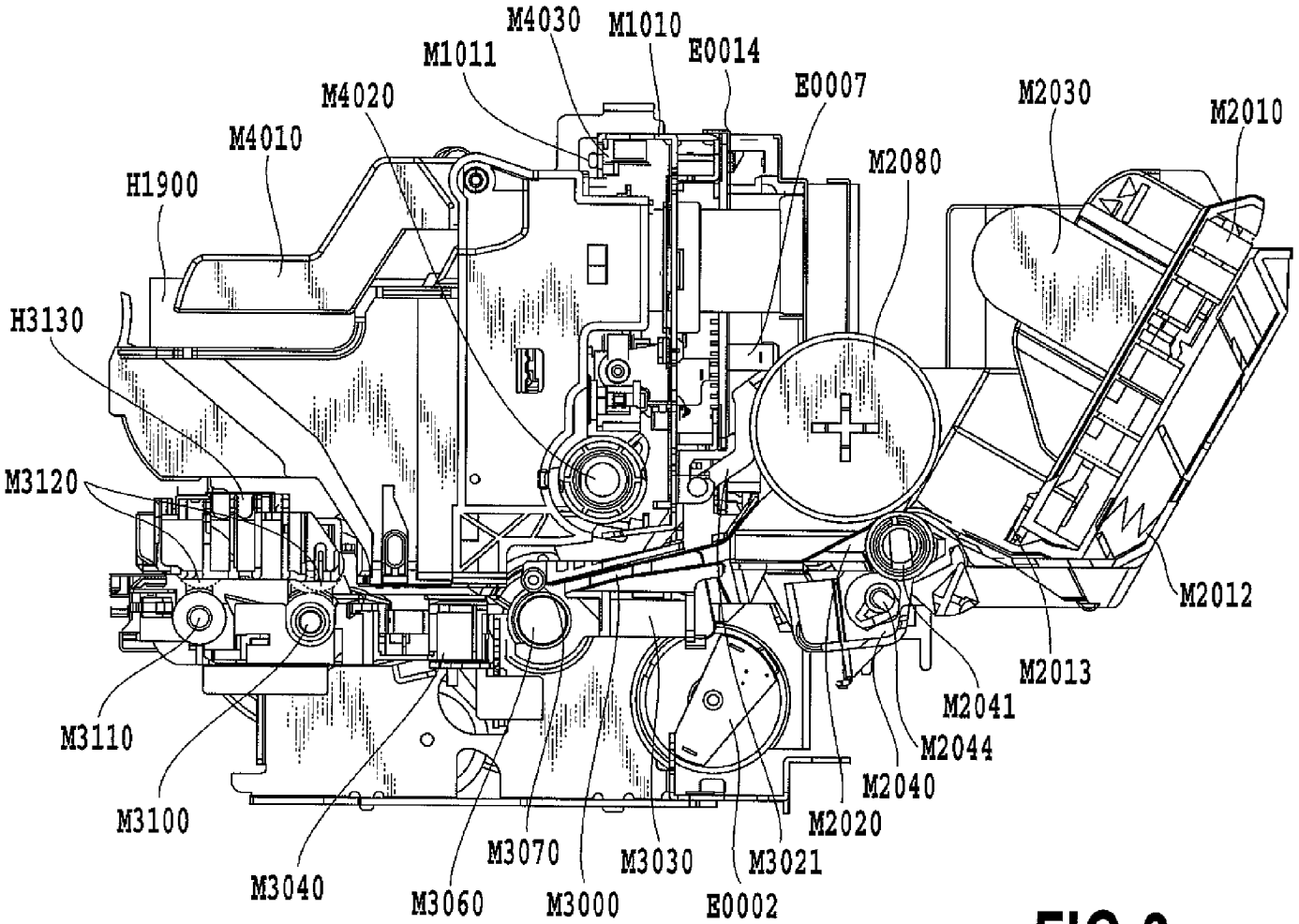
FIG. 3 is a side sectional view of the inkjet printing apparatus in the embodiment of the present invention.
Figure 4:
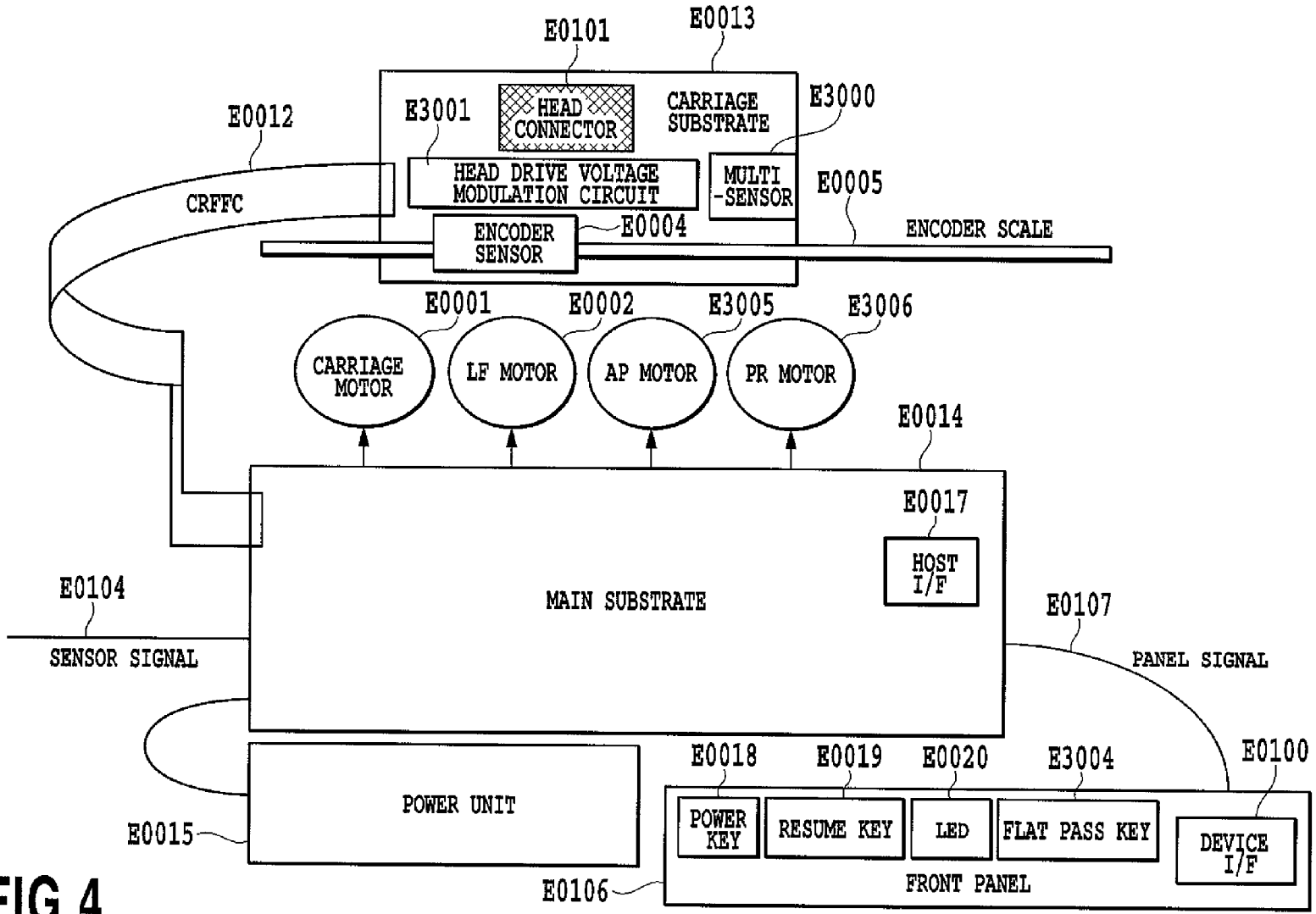
FIG. 4 is a block diagram schematically showing a configuration of an electric circuit in the embodiment of the present invention.

FIG. 3 is a side view of the same inkjet printing apparatus, and FIG. 4 is a block diagram for schematically explaining the overall configuration of an electric circuit in the printing apparatus.

(Carriage Portion)

A carriage portion has a carriage M4000 to be attached with a printing head H1001, and the carriage M4000 is supported by a guide shaft M4020 and a guide rail M1011. The guide shaft M4020 is attached to a chassis M1010, and guides and supports the carriage M4000 so as to perform reciprocating scanning in a main scanning direction (X-direction) that is a perpendicular direction to a delivering direction (arrow Y-direction) of a printing medium. The guide rail M1011 is formed integrally with the chassis M1010, and plays a role of maintaining a gap between the printing head H1001 that holds a rear end of the carriage M4000 and the printing medium on which printing is performed. In addition, on a sliding side of the guide rail M1011 in contact with the carriage M4000, provided in a tensioned state is a sliding sheet M4030 of a thin plate made of stainless steel or the like, for a reduction in sliding noise generation in the printing apparatus.

The carriage M4000 is driven by a carriage motor E0001 attached to the chassis M1010 via a timing belt M4041. In addition, the timing belt M4041 is provided in a tensioned state and supported by an idle pulley M4042. Furthermore, the timing belt M4041, which is combined with the carriage M4000 via a carriage damper made of rubber or the like, dampens vibration of the carriage motor E0001 and the like to reduce unevenness of an image to be printed.

An encoder scale E0005 for detecting the position of the carriage M4000 is provided parallel to the timing belt M4041. On the encoder scale E0005, formed are markings at a pitch of 1501 pi to 3001 pi. Then, an encoder sensor for reading out the markings is provided on a carriage substrate E0013 mounted on the carriage M4000. On the carriage substrate, also provided is a head contact E0101 for making an electrical connection with the printing head H1001. Also, to the carriage M4000, connected is a flexible cable E0012 for transmitting a drive signal from an electric substrate E0014 to the printing head H1001.

As a construction for fixing the printing head H1001 to the carriage M4000, the following is provided. More specifically, provided on the carriage M4000 are an unillustrated striking portion for positioning while pressing the printing head H1001 against the carriage M4000 and an unillustrated pressing unit for fixing the printing head H1001 to a fixed position. The pressing unit is mounted on a head set lever M4010, and when setting the printing head H1001, turns the head set lever M4010 around a rotation support so that a pressing force acts on the printing head H1001.

Furthermore, attached to the carriage M4000 is a position detecting sensor M4090 consisting of a reflective optical sensor, for position detection when performing printing on a special medium such as a CD-R and of a printing result, a sheet end, and the like. The position detecting sensor M4090 can detect the position of the carriage M4000 by emitting light by a light-emitting element and receiving a reflected light thereof.

When printing is performed in the abovementioned configuration, a printing medium is delivered in a sub-scanning direction by a roller pair consisting of a delivery roller M3060 and a pinch roller M3070. Then, by the carriage motor E0001, the carriage M4000 is moved in the main scanning direction that is a direction vertical to the sub-scanning direction so as to position the printing head H1001 at an objective image forming position. The printing head H1001 thus positioned ejects ink onto the printing medium in accordance with a signal from the electric substrate E0014 to perform printing. A detailed configuration of the printing head H1001 and a printing system will be described later. In the printing apparatus of the present embodiment, a printing main scan where the carriage M4000 mounted with the printing head H1001 performs scanning and a sub-scan where the printing medium is delivered by the delivery roller M3060 are alternately repeated. Thereby, an image is formed on the printing medium.

(Cleaning Portion)

Figure 5:
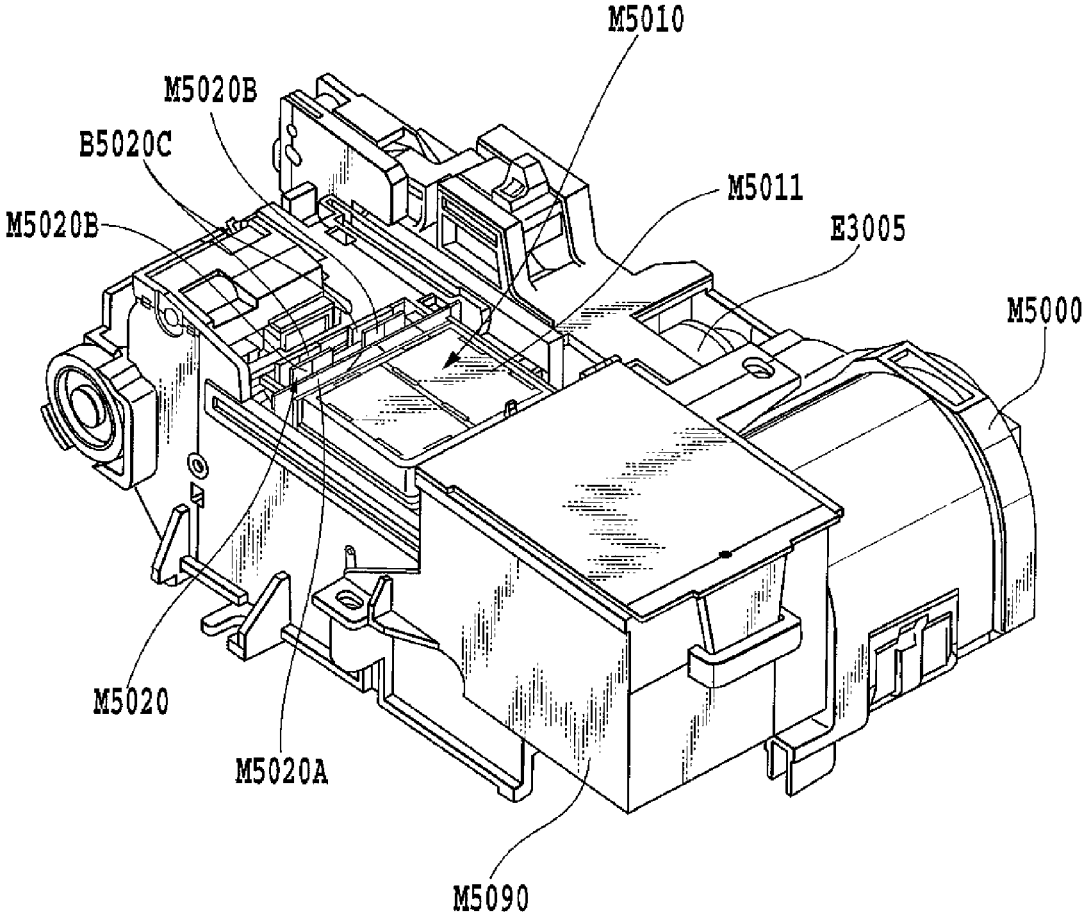
FIG. 5 is a perspective view showing a cleaning portion in a printing apparatus body used in the embodiment of the present invention.
Figure 6:
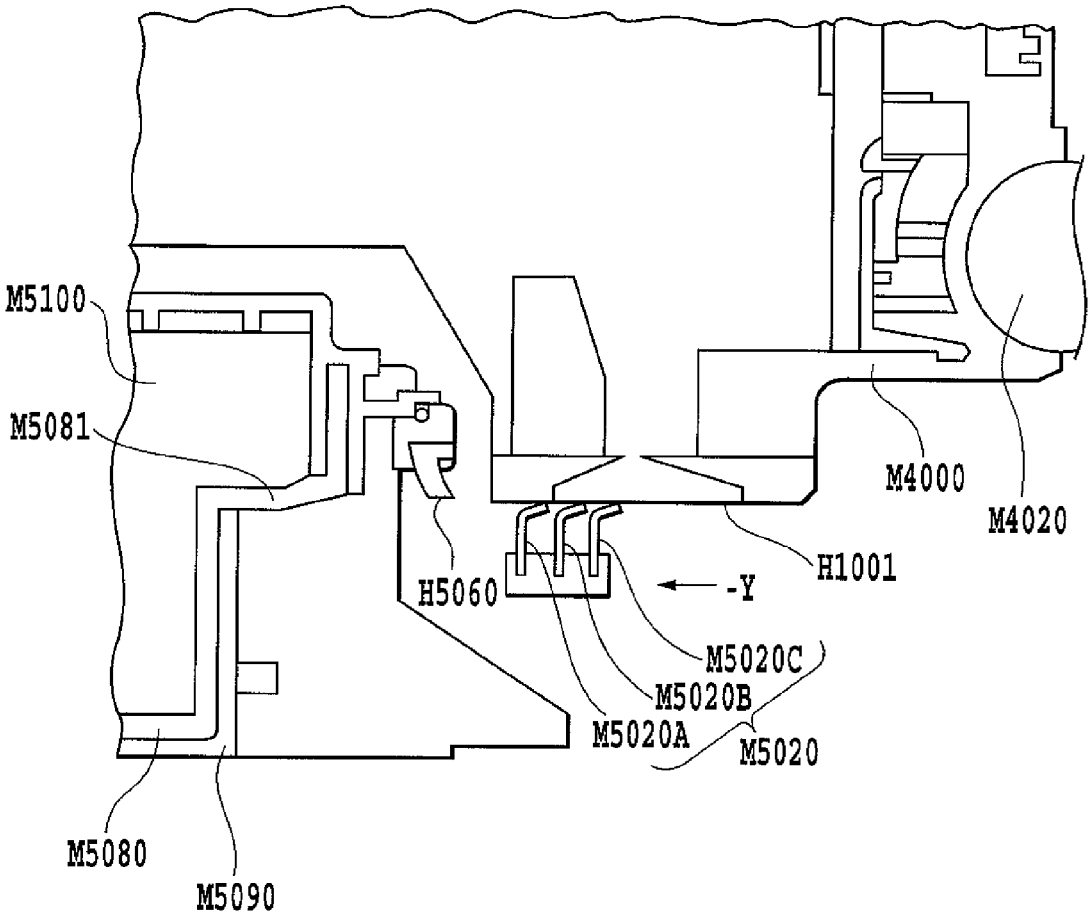
FIG. 6 is a sectional view for explaining a wiper portion in the cleaning portion of FIG. 5.

FIG. 5 is a perspective view showing a cleaning portion provided in the printing apparatus of the present embodiment. In addition, FIG. 6 is a side view showing a state of wiping that is a part of a cleaning operation being applied to a printing surface of the printing head.

The cleaning portion is a mechanism for cleaning the printing head H1001. The cleaning portion includes a pump M5000, a cap M5010 for preventing the printing head H1001 from drying, a blade M5020 for cleaning an ejection port forming surface of the printing head H1001, and the like.

In the present embodiment, a main driving force of the cleaning portion is transmitted from an AP motor E3005. A rotation of the AP motor E3005 in one direction actuates the pump M5000, and a rotation in an opposite direction thereof moves the blade M5020 and lifts and lowers the cap M5010. Although the AP motor E3005 used in the present embodiment is used also for a driving source of a feeding operation of a printing medium, a motor exclusively for operating the cleaning portion may be provided.

The cap M5010 is constructed so that a lifting and lowering operation can be performed via an unillustrated lifting and lowering mechanism by the AP motor E3005. And, at its lifted position, it is possible to apply capping to a surface where ejection ports are disposed (hereinafter, also simply referred to as an ejection port surface) of the printing head H1001 so as to protect the ejection port surface in a non-printing operation or the like or perform a suction recovery. Also, in a printing operation, the cap M5010 is set at a lowered position to avoid interference with the printing head H1001, and can receive preliminary ejecting at a position opposed to the ejection port surface. For example, ten ejection portions are provided on the printing head H1001, and in order to make it possible to apply capping to the ejection port surface for every five ejection portions collectively, two caps M5010 are provided in the example shown in FIG. 5.

The wiper portion M5020 made of an elastic member such as rubber is fixed to an unillustrated wiper holder. The wiper holder is movable in an arrow Y-direction (disposing direction of ejection ports in ejection portions) of FIG. 6. In the wiper portion M5020 of the present example, provided is a wiper blade M5020A that wipes the entire surface of the printing head H1001 including faces of all ejection portions. In addition, each one of the two wiper blades M5020B and M5020C that wipe nozzle peripheries are provided for faces for every five ejection portions.

The wiper holder moves in the arrow Y-direction when the printing head H1001 has reached the home position, whereby wiping becomes possible. When the wiping operation ends, the carriage is retracted out from the wiping area, and then each wiper is returned to a position not to interfere with the ejection port surface and the like.

Then, after wiping, the wiper portion M5020 contacts with a blade cleaner M5060, whereby ink and the like adhered to the wiper blades M5020A to M5020C can also be removed.

For the suction pump M5000, it is possible, when the cap M5010 is brought into contact with the ejection port surface, to generate a negative pressure inside thereof. This allows filling ink into the ejection portion from an ink tank H1900 or sucking and removing dust, fixed matter, bubbles, and the like that exist in the ejection port or an ink path located medial thereto.

As the suction pump M5000, used is one that is, for example, in a tube pump form. This pump includes a member formed with a curved surface to hold at least a part of a tube with flexibility therealong, a roller that is capable of pressing the flexible tube toward the same, and a roller support portion that is capable of rotating while supporting this roller. That is, as a result of rotating the roller support portion in a predetermined direction, the roller rolls while crushing the flexible tube on the curved surface formed member. As a result, a negative pressure is generated in a sealed space formed by the cap M5010 so that the ink is sucked from the ejection port and led into the tube or the suction pump from the cap M5010. Then, the ink thus led in is transferred to a member (waste ink absorber) provided on an unillustrated lower case.

Also, at an inner part of the cap M5010, provided is an absorber M5011 that absorbs ink remaining on the face of the printing head H1001 after suction. In addition, by sucking ink remaining in the cap M5010 or the absorber M5011 in a state where the cap M5010 has been lowered to open the ejection port surface, consideration is made so that fixation and a harmful effect thereafter due to residual ink do not occur. Here, it is preferable to provide an air open valve (not shown) in the middle of an ink suction channel and open this in advance when the cap M5010 is detached from the ejection port surface so that no sudden negative pressure acts on the suction port surface.

In addition, the suction pump M5000 can be actuated not only for a suction recovery but also for ejecting ink received by the cap M5010 due to a preliminary ejecting operation performed in a state where the cap M5010 is opposed to the ejection port surface. That is, by actuating the suction pump M5000 when the ink held in the cap M5010 by being preliminary jetted has reached a predetermined amount, the ink that has been held within the cap M5010 can be transferred to the waste ink absorber via the tube.

A series of operations such as the operation of the wiper portion M5020, lifting and lowering of the cap M5010, and opening and closing of the valve in the above that are performed in series can be controlled by an unillustrated main cam provided on an output shaft of the AP motor E3005 and a plurality of cams that follows the same, an arm, and the like. That is, the cam portion, and arm, and the like in respective parts are actuated by a turn of the main cam according to a rotating direction of the AP motor E3005, whereby a predetermined operation can be performed. The position of the main cam can be detected by a position detection sensor such as a photointerrupter.

(Electric Circuit Configuration)

Next, description will be given of a configuration of an electric circuit in the present embodiment.

Figure 7:
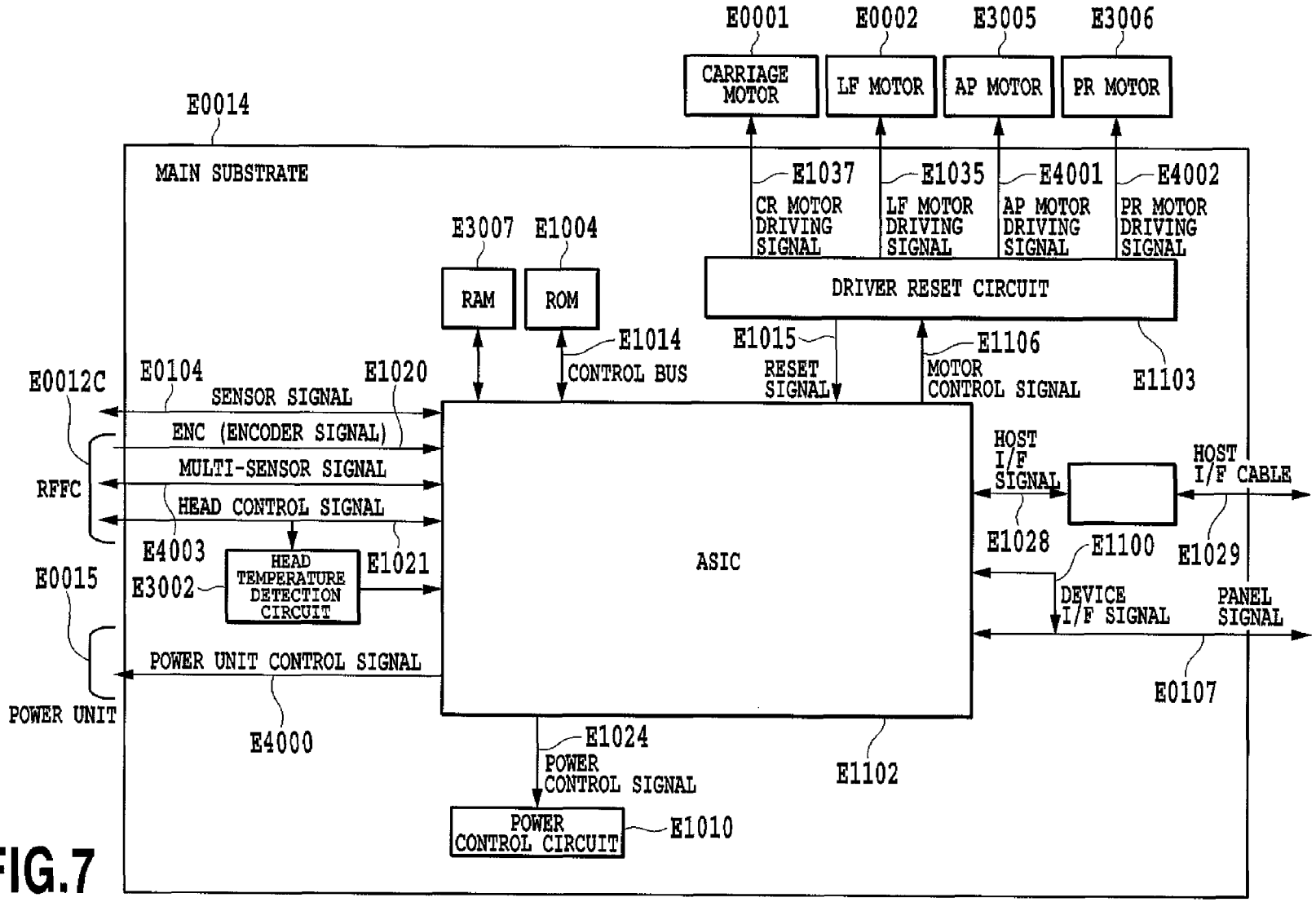
FIG. 7 is a block diagram showing an internal configuration of a main substrate in FIG. 6.
Figure 8:
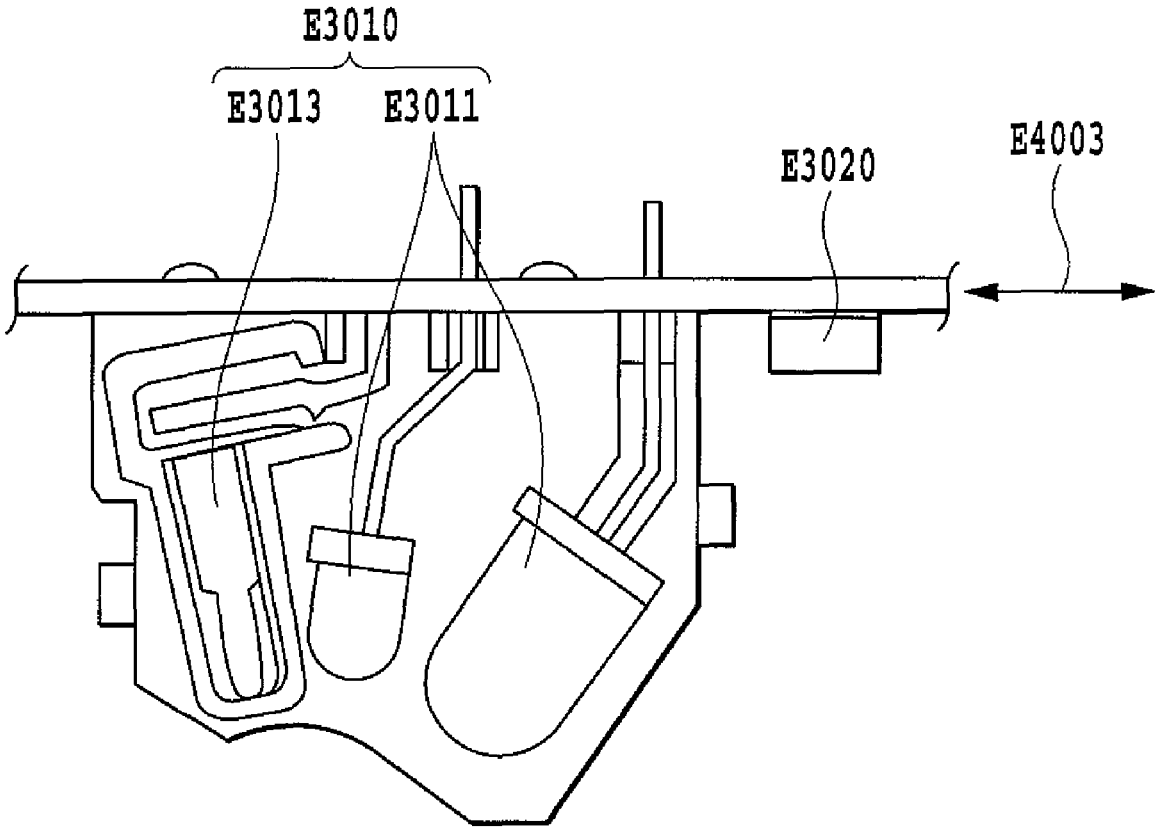
FIG. 8 is a view showing a configuration of a multi-sensor in FIG. 6.

FIG. 7 is a block diagram showing an internal configuration of a main substrate E0014, and FIG. 8 is a view showing a configuration of a multi-sensor E3000 so as to be understood. The following description refers to FIG. 4, FIG. 7, and FIG. 8.

The electrical circuit of the printing apparatus applied in the present embodiment is composed mainly of the carriage substrate E0013, the main substrate E0014, a power unit E0015, and a front panel E0106. Here, the power unit E0015 is connected with the main substrate E0014 to supply various driving powers.

The carriage substrate E0013 is a printed board unit mounted on the carriage M4000, and functions as an interface that performs a signal transfer with respect to the printing head H1001 and a supply of a head driving power through a head connector E0101. As a part used for control of the head driving power, the carriage substrate E0013 has a head drive voltage modulation circuit E3001 with a plurality of channels to the respective ejection portions of the printing head H1001. And, this generates a head driving power voltage in accordance with conditions specified by the main substrate E0014 through a flexible flat cable (CRFFC) E0012. In addition, based on a pulse signal outputted from an encoder sensor E0004 as a result of a movement of the carriage M4000, this detects a change in the positional relationship between the encoder scale E0005 and encoder sensor E0004. Further, this outputs the output signal to the main substrate E0014 through the flexible flat cable (CRFFC) E0012.

To the carriage substrate E0013, as shown in FIG. 8, connected are an optical sensor E3010 composed of two light emitting elements (LEDs) E3001 and a light receiving element E3013 and a thermistor E3020 for detecting an ambient temperature. Hereinafter, these sensors are referred to as a multi-sensor E3000. Information obtained by the multi-sensor E3000 is outputted to the main substrate E0014 through the flexible flat cable (CRFFC) E0012.

The main substrate E0014 is a printed board unit that takes charge of drive control of the respective portions of the inkjet printing apparatus in the present embodiment. The main substrate E0014 has a host interface (host I/F) E0017 on its printed board, and controls a printing operation based on data received from an unillustrated host computer. In addition, the main substrate E0014 is connected with various motors such as the carriage motor E0001, an LF motor E0002, the AP motor E3005, and a PR motor E3006 and controls drive of the respective functions. The carriage motor E0001 is a motor serving as a driving source to make the carriage M4000 perform a main scan. The LF motor E0002 is a motor serving as a driving source to deliver a printing medium. The AP motor E3005 is a motor serving as a driving source of a recovery operation of the printing head H1001 and a feeding operation of a printing medium. The PR motor E3006 is a motor serving as a driving source of a flat-pass printing operation. Further, the main substrate E0014 is connected to a sensor signal E0104 that is for transmitting and receiving a control signal and a detection signal with respect to a variety of sensors that detect operating states of the respective printer portions, such as a PE sensor, a CR lift sensor, an LF encoder sensor, and a PG sensor. In addition, the main substrate E0014 is connected to the CRFFC E0012 and the power unit E0015, respectively, and further has an interface to perform an information transfer with respect to the front panel E0106 via a panel signal E0107.

The front panel E0106 is a unit provided at the front of the printing apparatus body for the sake of convenience when being operated by a user. This has a resume key E0019, an LED E0020, a power key E0018, and a flat-pass key E3004, and further has a device I/F E0100 that is used for a connection with a peripheral device such as a digital camera or the like.

In FIG. 7, reference numeral E1102 denotes an ASIC. This is connected to a ROM E1004 through a control bus E1014, and performs various controls in accordance with a program stored in the ROM E1004. For example, this transmits and receives the sensor signal E0104 related to various sensors and a multi-sensor signal E4003 related to the multi-sensor E3000. Moreover, this detects an encoder signal E1020 and states of output from the power key E0018, resume key E0019, and flat-pass key E3004 on the front panel E0106. In addition, the ASIC E1102 performs various logic operations and conditional judgments, and the like according to the state of connection and data input of the device I/F E0100 on the front panel to control the respective components, and thus takes charge of drive control of the inkjet printing apparatus.

Reference numeral E1103 denotes a driver reset circuit. This generates, in accordance with a motor control signal E1106 from the ASIC E1102, a CR motor drive signal E1037, an LF motor drive signal E1035, an AP motor drive signal E4001, and a PR motor drive signal E4002 to drive the respective motors. Further, the drive reset circuit E1103 has a power circuit to supply a necessary power to the respective portions such as the main substrate E0014, carriage substrate E0013, and front panel E0106. Further, this detects a decline in power voltage to generate a reset signal E1015 and perform initialization.

Reference numeral E1010 denotes a power control circuit, which controls a power supply to the respective sensors having light emitting elements and the like in accordance with a power control signal E1024 from the ASIC E1102.

The host I/F E0017 transmits a host I/F signal E1028 from the ASIC E1102 to a host I/F cable E1029 connected to the outside, and transmits a signal from this cable E1029 to the ASIC E1102.

On the other hand, from the power unit E0015, electricity is supplied. The supplied electricity is supplied to the respective portions inside and outside the main substrate E0014 after voltage conversion according to necessity. A power unit control signal E4000 from the ASIC E1102 is connected to the power unit E0015 to control a low-power consumption mode and the like of the printing apparatus body.

The ASIC E1102 is a one-chip semiconductor integrated circuit having a built-in arithmetic processing unit, which outputs the aforementioned motor control signal E1106, power control signal E1024, power unit control signal E4000, and the like. And, this performs a signal transfer with respect to the host I/F E0017, and performs a signal transfer with respect to the device I/F E0100 on the front panel through the panel signal E0107. Further, this detects a state by the sensors for the respective portions such as the PE sensor, an ASF sensor, and the like through the sensor signal E0104. Further, this controls the multi-sensor E3000 through the multi-sensor signal E4003 and detects a state. In addition, this detects a state of the panel signal E0107 and controls drive of the panel signal E0107 to flash the LED E0020 on the front panel.

Further, the ASICE 102 detects a state of the encoder signal (ENC) E1020 and generates a timing signal to control a printing operation in a manner interfaced with the printing head H1001 by a head control signal E1021. Herein, the encoder signal (ENC) E1020 is an output signal of the encoder sensor E0004 inputted through the CRFFC E0012. In addition, the head control signal E1021 is connected to the carriage substrate E0013 through the flexible flat cable E0012. Then, this signal is supplied to the control head H1001 through the aforementioned head drive voltage modulation circuit E3001 and head connector E0101, and transmits various types of information from the printing head H1001 to the ASIC E1102. Of this, head temperature information in every ejection portion is signal-amplified by a head temperature detection circuit E3002 on the main substrate, then is inputted to the ASIC E1102, and used for various control judgments.

In the drawings, reference numeral E3007 denotes a DRAM, which is used not only as a printing data buffer, a buffer of data received from the host computer, and the like, but also as a work area necessary for various control operations.

(Printing Head Configuration)

Next, description will be given of a configuration of a head cartridge H1000 applied in the present embodiment.

The head cartridge H1000 in the present embodiment has a unit for mounting the ink tank H1900 on the printing head H1001 and supplying ink from the ink tank H1900 to the printing head. And, this is mounted so as to be attachable and detachable with respect to the carriage M4000.

Figure 9:
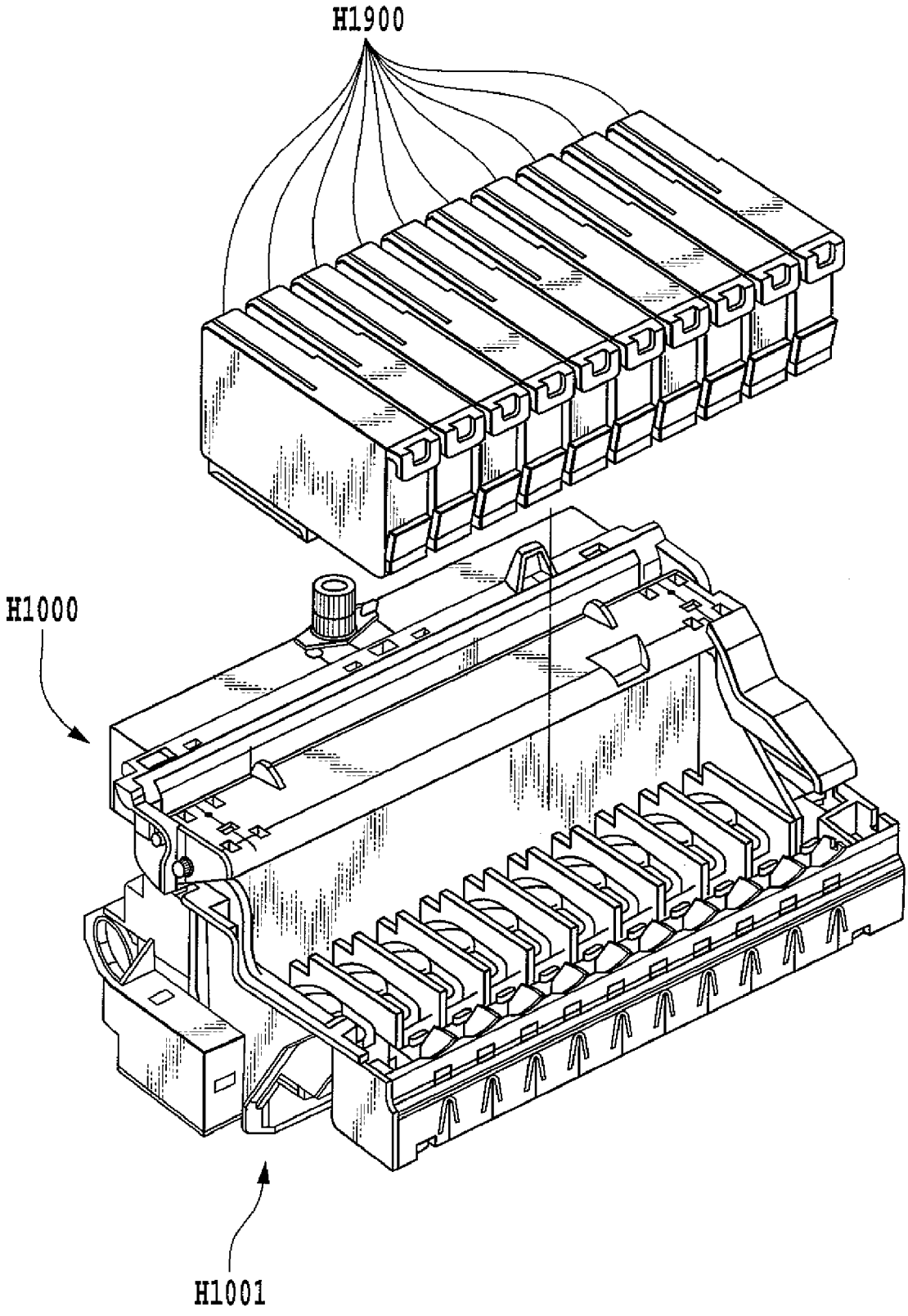
FIG. 9 is a perspective view showing a state where ink tanks are attached to a head cartridge.
Figure 10:
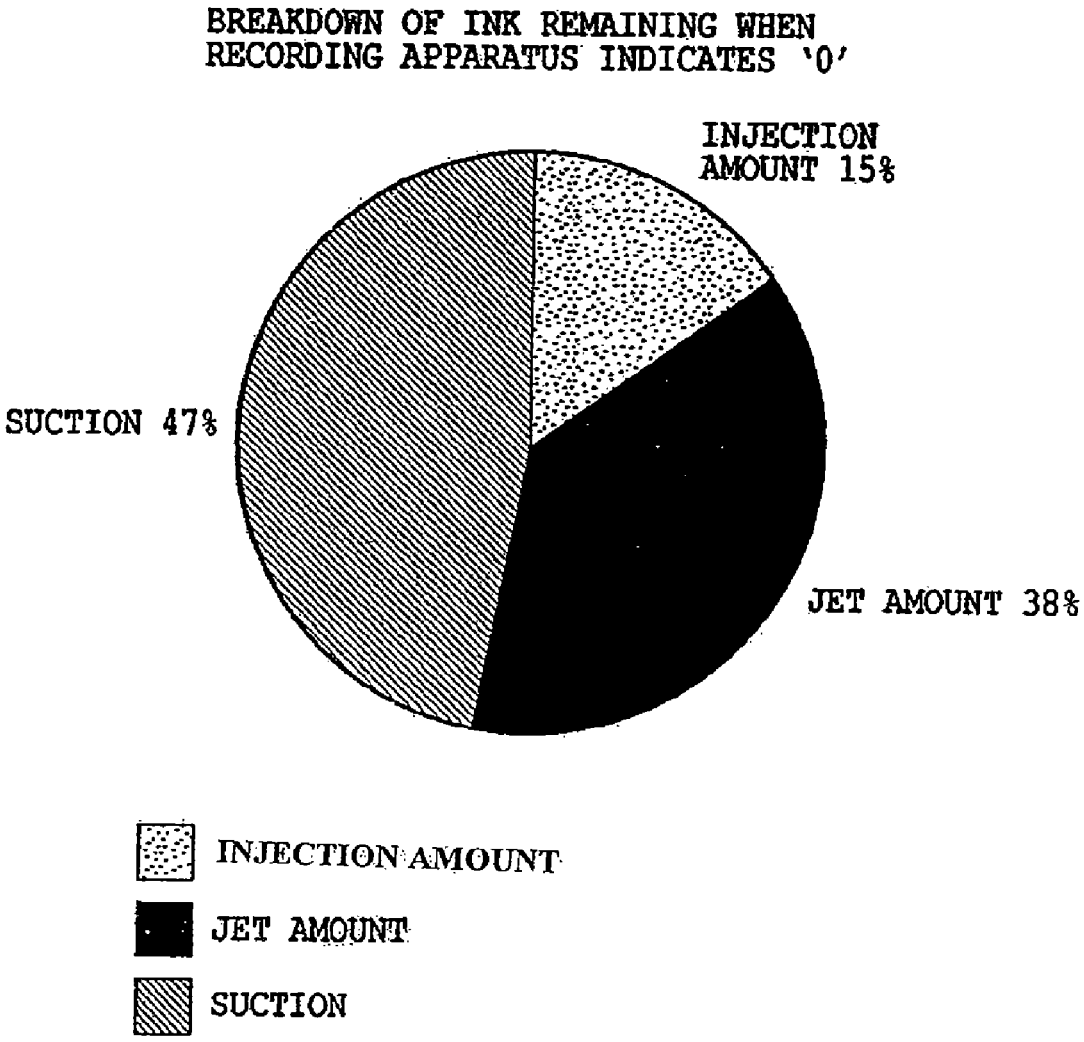
FIG.10 PRIOR ART
FIG. 10 is a graph showing a breakdown of ink remaining when the printing apparatus has indicated a residual amount 0.

FIG. 9 is a view showing a state where the ink tanks H1900 are attached to the head cartridge H1000 applied in the present embodiment. The printing apparatus of the present embodiment forms an image of 10 colors of pigment inks. The 10 colors consist of cyan (C), light cyan (Lc), magenta (M), light magenta (Lm), yellow (Y), first black (K1), second black (K2), red (R), green (G), and gray (Gray). Accordingly, as the ink tanks as well, ink tanks for these 10 colors are independently prepared. And, as shown in the figure, the respective ink tanks are freely attachable and detachable with respect to the head cartridge H1000. Here, the ink tanks H1900 can be attached and detached in a state where the head cartridge H1000 has been mounted on the carriage M4000.

2. Characteristic Configuration

A characteristic configuration of the present invention will be described.

In the inkjet printing apparatus of the present embodiment, in order to reduce the error between the ink consumption calculated by the printing apparatus and the actually consumed ink amount, the ejecting amount from the printing head and the suction amount for a head recovery are respectively ranked. The ink consumption is calculated by selectively using these ranks. In the following, a "ejecting amount rank (ejecting amount rank information) is the quantity of the ink ejecting amount due to an individual difference in the printing head having been ranked, which is information corresponding to the ejecting amount unique to the printing head. For example, as the ejecting amount ranks, M ranks are provided in a manner corresponding to M (M is an integer equal to or more than 2) stages of the ejecting amount. Accordingly, making reference to the ejecting amount rank of the printing head allows grasping the ink amount discharged out by one time of ejecting operation of that printing head, whereby the error due to a fluctuation in the ejecting amount can be reduced. Similarly, a "suction amount rank (suction amount rank information) is the quantity of the ink suction amount due to an individual difference in the printing apparatus having been ranked, which is information corresponding to the ejecting amount unique to the printing apparatus. For example, as the suction amount ranks, N ranks are provided in a manner corresponding to N (N is an integer equal to or more than 2) stages of the suction amount. Accordingly, making reference to the suction amount rank of the printing apparatus allows grasping the ink amount suctioned by one time of ejecting operation of that printing apparatus, whereby the error due to a fluctuation in the suction amount can be reduced.

Hereinafter, the method will be described. FIG. 11 is a view showing the amount assumed to be consumed by one time of a suction process (hereinafter, also simply referred to as a suction amount OFA) by rank determined by the apparatus, and further showing a relationship therebetween by suction mode.

Here, Suction A is a suction mode where the suction amount is the smallest with a short suction time and a small number of times of suction, the time and number of times of suction are increased so that the suction amount is increased in Suction B and Suction C in order, and Suction D shows a suction mode where the suction amount is greatest. This table is stored in the ROM E1004 of the printing medium, and is selectively used when the ink consumption is calculated.

When the printing apparatus is powered on, a rank of the suction amount preset at the time of manufacturing is obtained from the DRAM E3007. Then, the suction amount OFA is read from the ROM E1004 based on the obtained rank. Then, when printing is started to perform suction, the suction amount OFA according to the suction mode is recognized as an ink consumption by a sucking operation. For example, in a printing apparatus, when the suction amount rank has been set to "3", if the suction mode D is performed, the specified ink amount becomes 1.32 g, so that an ink amount of 1.32 g is calculated as the ink consumption.

Then, the ink consumption by one time of sucking operation thus calculated is added to a cumulative consumption of ink consumed by the printing apparatus so far to update the cumulative consumption. The cumulative consumption thus updated is written into the DRAM E3007, and the ink consumption at the present time is managed by the printing apparatus. The residual amount of ink in the ink tank is estimated based on the ink consumption at the present time obtained as such, and when it is judged that the estimated residual ink amount is "0" or "equal to or less than a predetermined amount," a notice is given to prompt a user to replace the ink tank. By adopting the suction amount rank as in the above, the error due to a fluctuation in the suction amount can be reduced. Also, the cumulative consumption is equal to a sum total of a value of ink consumptions resulting from a sucking operation calculated based on the suction amount rank as described above cumulatively added and a value of ink consumptions resulting from an ejecting operation cumulatively added.

By using the suction amount OFA for a calculation as such, even if the ink consumption by a sucking operation is different in every printing apparatus, it is never recognized that an excessively large ink has been consumed, and a correct ink consumption closer to the actually consumed ink amount can be calculated. Therefore, the difference in the ink consumption recognized by the printing apparatus and the actually consumed ink amount is reduced. Accordingly, reduced is the possibility of a judgment that the residual ink amount has become "0" or "equal to or less than a predetermined amount" although sufficient ink actually remains, so that the ink is never wastefully disposed of, and the running cost can be lowered.

Although the suction amount has been divided into three ranks, without limitation hereto, this may be divided into a larger number of ranks.

Figure 18A:
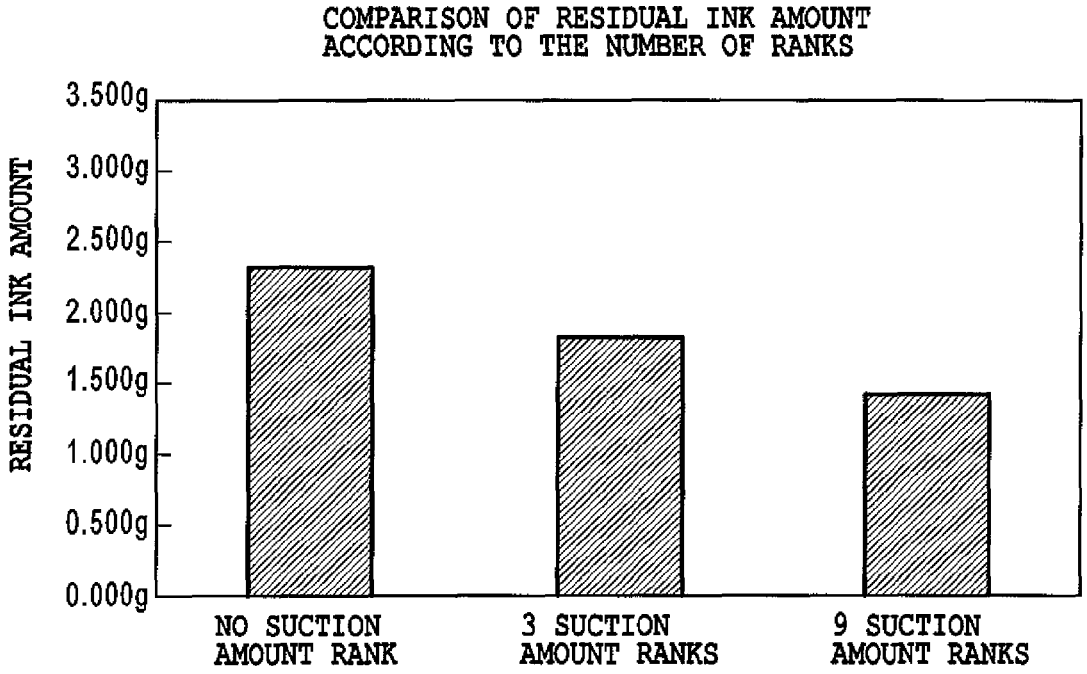
FIGS. 18A and 18B are Graphs showing a difference in the residual ink amount according to the number of ranks set for printing.

FIG. 18A is a view showing a residual amount of ink in the ink tank according to the number of divided ranks. For reference, compared were residual amounts of ink in the ink tank in a case where no ranks were used, a case where the suction amount was divided into three ranks (the suction amount changes by 10% per one rank), and a case where the suction amount was divided into nine ranks (the suction amount changes by 2% per one rank). As can be understood from FIG. 18A, providing a larger number of ranks allows further reducing the error in the residual ink amount. Therefore, it is preferable to use a table with an increased number of ranks.

Moreover, in the present embodiment, it has been described to obtain the rank of the suction amount set at the time of manufacturing, however, without limitation hereto, a unit with which a user can measure the suction amount may be provided so that the user can set the rank based on the measurement result.

Second Embodiment

The present invention is characterized in that ranks have been decided on the ink ejecting amount per one time, and other aspects of the configuration are the same as those of the first embodiment. Hereinafter, a second embodiment of the present invention will be described.

FIG. 12 is a view showing as a table a relationship between the amount assumed to be consumed by one time of ejecting (hereinafter, also simply referred to as an ejecting amount OFB) and rank. In the present embodiment, the ejecting amount is divided into nine ranks from rank 1 to rank 9. This table is stored in the ROM E1004 of the printing apparatus.

When the printing apparatus is powered on, from a substrate memory (unillustrated) provided in the printing head H1001, an ejecting amount rank preset at the time of manufacturing is obtained, and according to the rank, an ejecting amount OFB in this table is selectively used at the time of calculation of the ink consumption. Concretely, when printing is started to perform an ejecting operation, the ink amount consumed by the ejecting operation is calculated at a predetermined timing. As the predetermined timing, every time printing of one sheet has been completed or every time printing of one job has been completed is preferred. And, in a step of calculating the ink amount consumed by an ejecting operation, a value of the ejecting amount OFB corresponding to the obtained rank multiplied by a dot count number DC is calculated as the ink consumption.

For example, when a rank "4" has been stored in one printing head, in this head, the consumption by one time of ejecting is set to 3.5 nm, and this is multiplied by a dot count number, and the product is added as a consumed ink amount (or subtracted as a residual ink amount). Specifically, when the dot count number is 10000, by 1000×3.5=35000 ng, the consumption is calculated.

Then, the ink consumption by an ejecting operation thus calculated is added to a cumulative consumption of ink consumed by the printing apparatus so far to update the cumulative consumption. The cumulative consumption thus updated is written in to the DRAM E3007, and the ink consumption at the present time is managed by the printing apparatus. The residual amount of ink in the ink tank is estimated based on the ink consumption at the present time obtained as such, and when it is judged that the estimated residual ink amount is "0" or "equal to or less than a predetermined amount," a notice is given to prompt a user to replace the ink tank. By adopting the ejecting amount rank as in the above, the error due to a fluctuation in the ejecting amount can also be reduced. Also, the cumulative consumption is equal to a sum total of a value of ink consumptions resulting from a sucking operation cumulatively added and a value of ink consumptions resulting from an ejecting operation calculated based on the ejecting amount rank cumulatively added.

By using the ejecting amount OFB for a calculation as such, even if the ink consumption by an ejecting operation is different in every printing apparatus, it is never recognized that an excessively large amount of ink has been consumed, and a correct ink consumption closer to the actually consumed ink amount can be calculated. Therefore, the difference in the ink consumption recognized by the printing apparatus and the actually consumed ink amount is reduced.

Figure 18B:
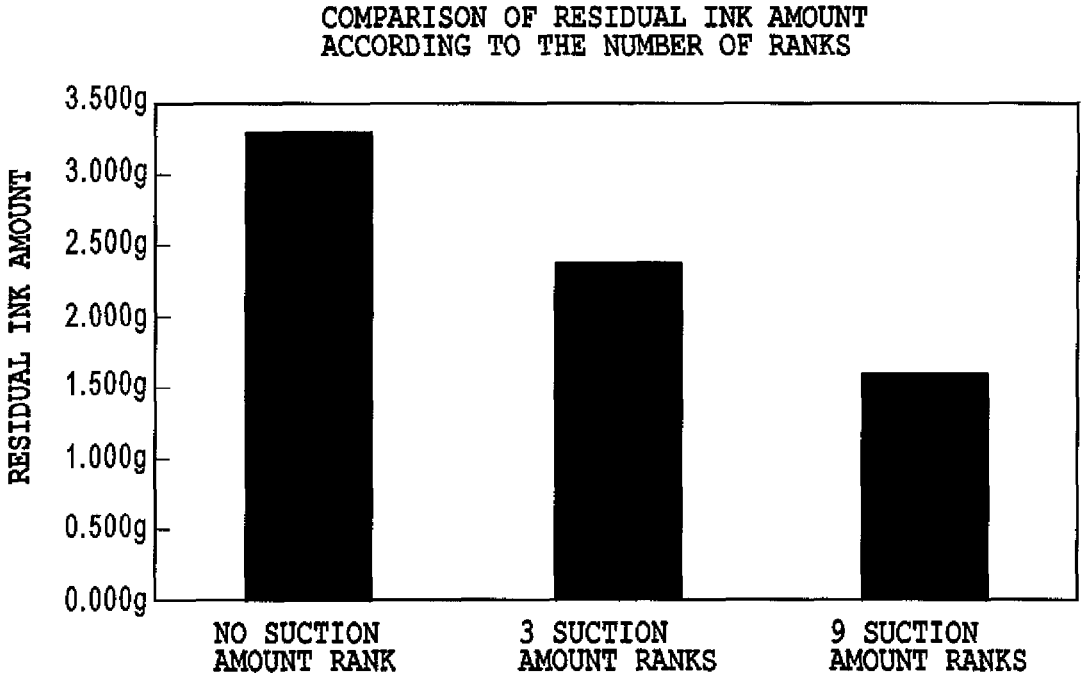

FIG. 18B is a view showing a residual amount of ink in the ink tank according to the number of divided ranks. For reference, compared were residual amounts of ink in the ink tank in a case where no ranks were used, a case where the ejecting amount was divided into three ranks (the ejecting amount changes by 0.5 ng per one rank), and a case where the ejecting amount was divided into nine ranks (the ejecting amount changes by 0.1 ng per one rank). As can be understood from FIG. 18B, since providing a larger number of ranks allows further reducing the residual ink amount, it is preferable to use a table with an increased number of ranks.

Moreover, in the present embodiment, it has been described to obtain the rank of the ejecting amount set at the time of manufacturing, however, without limitation hereto, a unit with which a user can measure the ejecting amount may be provided so that the user can set the rank based on the measurement result.

Third Embodiment

The present invention is characterized in that the target of a correction is both the ink suction amount and ink ejecting amount, and other aspects of the configuration are the same as those of the first and second embodiments. Hereinafter, a third embodiment of the present invention will be described.

The printing apparatus of the present embodiment stores the respective tables shown in FIG. 11 and FIG. 12 in the ROM E1004.

When the printing apparatus is powered on, a rank of the ejecting amount preset at the time of manufacturing is obtained from the DRAM E3007, and a rank of the ejecting amount preset at the time of manufacturing is obtained from a substrate memory (unillustrated) provided in the printing head H1001. And, according to the obtained respective ranks, a suction amount OFA and an ejecting amount OFB are selectively used from these tables at the time of calculation of the ink consumption.

Then, when printing is started to perform suction and ejecting, the suction amount corresponding to the suction amount rank is calculated as an ink consumption resulting from the sucking operation. In addition, a value of the ejecting amount OFB corresponding to the ejecting amount rank multiplied by a dot count number DC is calculated as an ink consumption resulting from the ejecting operation.

Then, the ink consumption by the ejecting operation and the ink consumption by the sucking operation thus calculated are added to a cumulative consumption of ink consumed by the printing apparatus so far to update the cumulative consumption. The cumulative consumption thus updated is written into the DRAM E3007, and the ink consumption at the present time is managed by the printing apparatus. The residual amount of ink in the ink tank is estimated based on the ink consumption at the present time obtained as such, and when it is judged that the estimated residual ink amount is "0" or "equal to or less than a predetermined amount," a notice is given to prompt a user to replace the ink tank. By using both the suction amount rank and ejecting amount rank as in the above, the error due to a fluctuation in the ejecting amount and a fluctuation in the ejecting amount can be reduced. Also, the cumulative consumption is equal to a sum total of a value of ink consumptions resulting from a sucking operation calculated based on the suction amount rank cumulatively added and a value of ink consumptions resulting from an ejecting operation calculated based on the ejecting amount rank cumulatively added.

Figure 13:
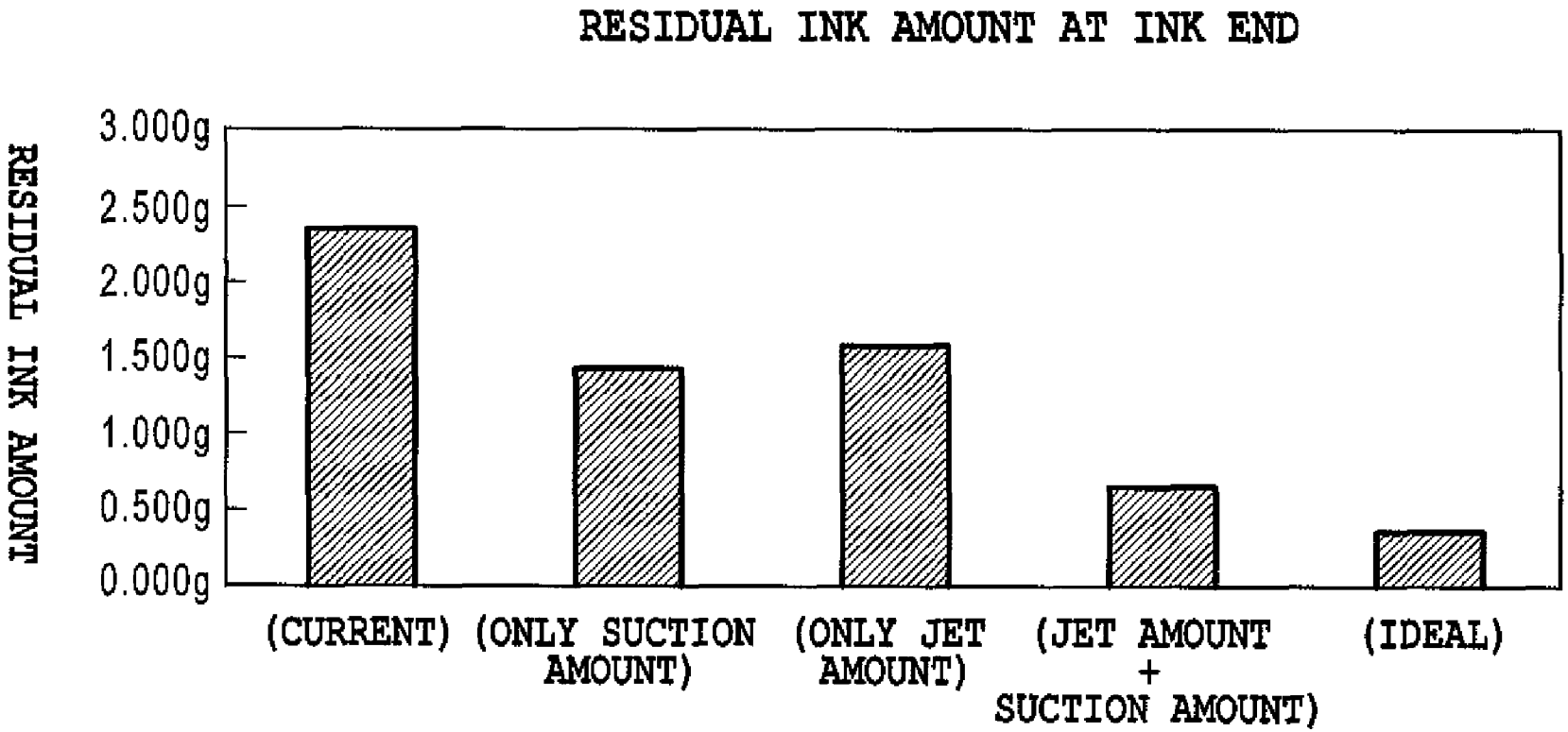
FIG. 13 is a graph showing residual ink amounts when the present invention has been carried out.

FIG. 13 is a view of comparison of the residual amount of ink in the ink tank when, in the conventional printing apparatus, the printing apparatuses of the first and second embodiments, and the printing apparatus of the present embodiment, the residual ink amount recognized by the printing apparatus has reached "0". In this figure, illustrated as an ideal value is the ink amount when the residual amount of ink in the ink tank due to fluctuations in the suction amount and ejecting amount is "0" and when only ink due to a fluctuation in the ink injection amount is remaining in the ink tank. Moreover, in FIG. 13, a bar denoted with "current" corresponds to the conventional printing apparatus, and a bar denoted with "only suction amount" corresponds to the printing apparatus of the first embodiment. Moreover, a bar denoted with "only ejecting amount" corresponds to the printing apparatus of the second embodiment, and a bar denoted with "ejecting amount+suction amount" corresponds to the printing apparatus of the present embodiment. As can also be understood from FIG. 13, the residual amount of ink in the ink tank is the smallest when printing was performed by the printing apparatus (ejecting amount+suction amount) of the present embodiment. Accordingly, by performing printing by use of the printing apparatus of the present embodiment, it is further assured that the ink is never wastefully disposed of, and the running cost of the printing apparatus can be lowered.

Moreover, in the present embodiment, it has been described to obtain the ranks of the suction amount and ejecting amount set at the time of manufacturing, however, without limitation hereto, a unit with which a user can measure the suction amount and ejecting amount may be provided so that the user can set the respective ranks based on the measurement result.

Fourth Embodiment

A fourth embodiment will be described. Generally, since the state of ink changes due to a change in the temperature of a printing head and a change in the environmental temperature, the ejecting amount and the suction amount are thereby increased and decreased. Therefore, for allowing a printing apparatus to more accurately recognize the ink consumption, it is desirable to correct the ejecting amount and the suction amount increased and decreased by this change in the temperature. Therefore, the printing apparatus of the present embodiment has a head temperature sensor and an environmental temperature sensor for detecting the temperature of the printing head and the environmental temperature. And, the ejecting amount and the section amount are corrected based on the temperature of the printing head and the environmental head. Other aspects of the configuration are the same as those of the third embodiment.

Figure 14:
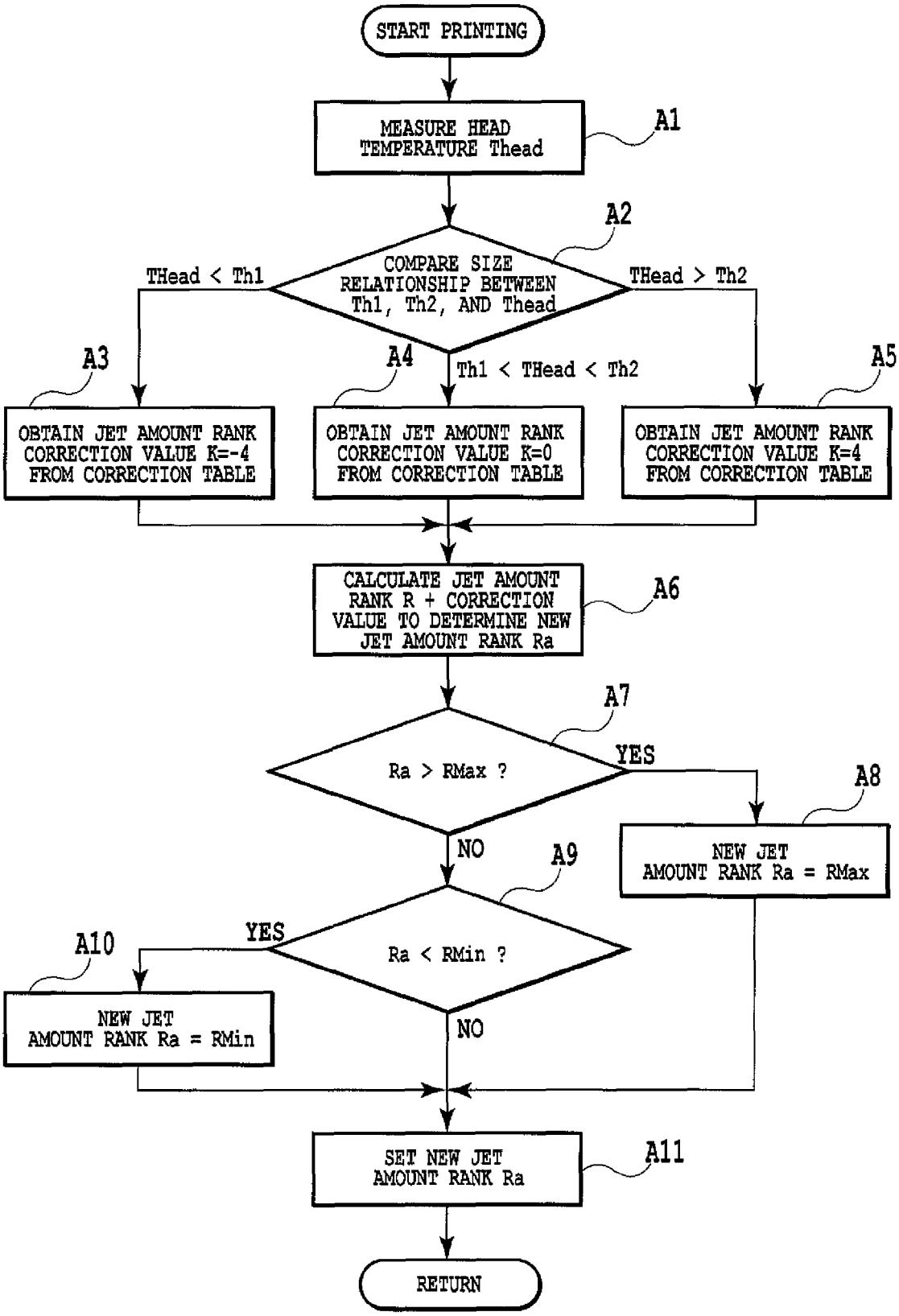
FIG. 14 is a flowchart explaining a third embodiment.
Figure 15:
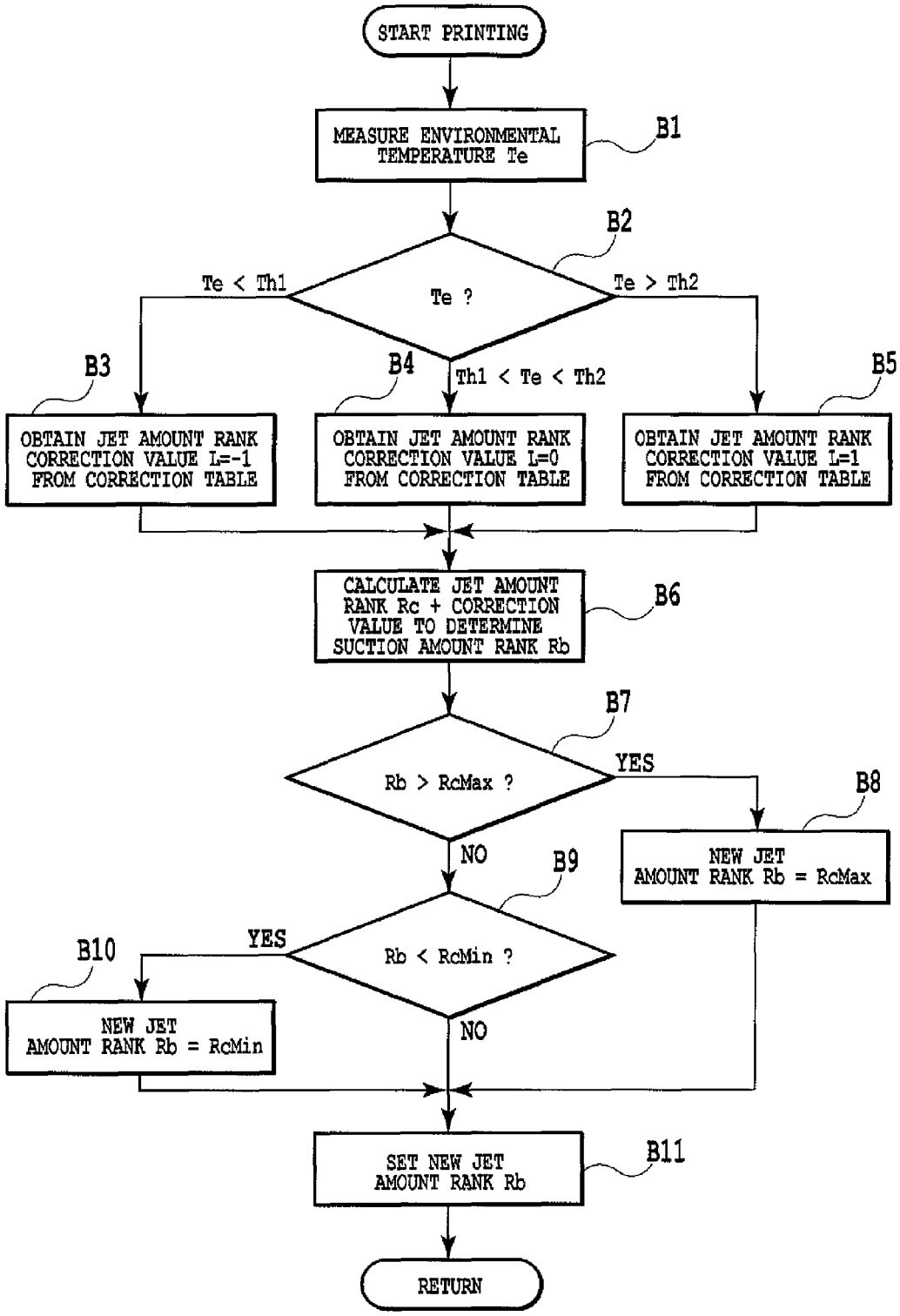
FIG. 15 is a flowchart explaining the third embodiment.

FIG. 14 is a flowchart showing a method for selecting a rank when correcting the ejecting amount in the printing apparatus of the present embodiment. In addition, FIG. 15 is a flowchart showing a method for selecting a rank when correcting the suction amount in the printing apparatus of the present embodiment.

In addition, FIG. 16 is a correction table concerning the printing head temperature used in a correction of the ejecting amount, and FIG. 17 is a correction table concerning the environmental temperature used in a correction of the suction amount.

First, description will be given of the flowchart of FIG. 14.

When printing of a print job has ended, in step A1, a printing head temperature THead is measured by the printing head temperature detection sensor. Next, the process proceeds to step A2, and a size relationship between the printing head temperature THead and prepared threshold values Th1 and Th2 is determined. Here, as an example, the threshold Th1 is provided as 10° C., and the threshold value Th2, 20° C. If the printing head temperature THead<the threshold value Th1, the process proceeds to step A3, and if the threshold value Th1<the printing head temperature THead<the threshold value Th2, the process proceeds to step A4, and if the printing head temperature THead>the threshold value Th2, the process proceeds to step A5.

In the respective steps A3, A4, and A5, according to the correction value table of FIG. 16 raised as an example of a correction value table, a correction value K=−4 is obtained as a correction value of the ejecting amount rank in step A3, a correction value K=0 is obtained in step A4, and a correction value K=4 is obtained in step A5. Next, the process proceeds to step A6, a rank R obtained by the same unit as the method for obtaining a rank of the ejecting amount in the printing apparatus of the third embodiment and the correction value K are added up to determine a new ejecting amount rank Ra.

Next, in step A7, it is determined whether this new ejecting amount rank Ra is greater than RMax (RMax=9 in FIG. 12), which is the maxim rank among the ejecting amount ranks shown in FIG. 12. If Ra>RMax, the process proceeds to step A8, the maximum rank RMax among the ejecting amount ranks is set as the ejecting amount rank.

Next, when Ra<RMax in step A7, the process proceeds to step A9. In step A9, it is determined whether this new ejecting amount rank Ra is smaller than RMin (RMax=1 in FIG. 12), which is the minimum rank among the ejecting amount ranks shown in FIG. 12, and if smaller, the process proceeds to step A10, the minimum rank RMin among the ejecting amount ranks is set as the ejecting amount rank. On the other hand, if the new ejecting amount rank Ra is greater than the minimum rank RMin, the process proceeds to step A11, the new ejecting amount rank Ra is set as the ejecting amount rank as it is. Based on the ejecting amount rank thus determined, the ejecting amount is selected, and the consumption of ink in the ink tank is calculated. Then, the ink consumption thus calculated is, as described above, added to the cumulative consumption consumed by the printing apparatus so far to update the cumulative consumption.

For example, when the obtained ejecting amount rank R is "Rank 6" and the head temperature is 25° C., the printing head temperature THead>the threshold value Th2 (∵Th2=20° C.), the rank correction value becomes "+4", and thus the new ejecting amount rank Ra=Rank R+4=6+4=10. However, the maximum rank among the ejecting amount ranks is RMax=9 from FIG. 12, and since Ra>RMax, it is set that the new ejecting amount rank Ra=9, and the ejecting amount is calculated, from the table of ejecting amount ranks of FIG. 12, as 4 ng.

Description will be given of a correction of the suction amount according to the flowchart of FIG. 15.

When a suction operation has ended, in step B1, an environmental temperature Te is measured by an environmental temperature detection sensor provided on a substrate of the printing apparatus. Next, the process proceeds to step B2, and a size relationship between the environmental temperature Te and prepared threshold values Teh1 and Teh2 is determined. Here, as an example, the threshold Teh1 is provided as 10° C., and the threshold value Teh2, 20° C. If Te<Teh1, the process proceeds to step B3, and if Teh1<Te<Teh2, the process proceeds to step B4, and if Te>Teh2, the process proceeds to step B5.

In the respective steps B3, B4, and B5, according to the correction value table of FIG. 17 raised as an example of a correction value table, a correction value L=−1 of the suction amount rank is obtained in step B3, a correction value L=0 is obtained in step B4, and a correction value L=1 is obtained in step B5. Next, the process proceeds to step B6, a rank Rc obtained by the same unit as the method for obtaining a rank of the ejecting amount in the printing apparatus of the third embodiment and a correction value L are added up to determine a new suction amount rank Rb.

Next, in step B7, it is determined whether this new suction amount rank Rb is greater than RMax (RMax=3 in FIG. 11), which is the maxim rank among the suction amount ranks shown in FIG. 11. If Ra>RMax, the process proceeds to step B8, the maximum rank RMax among the ejecting amount ranks is set as the ejecting amount rank.

Next, when Rb<RMax in step B7, the process proceeds to step B9. In step B9, it is determined whether this new suction amount rank Rb is smaller than RMin (RMin=1 in FIG. 11), which is the minimum rank among the ejecting amount ranks shown in FIG. 11, and if smaller, the process proceeds to step B10, the minimum rank RMin among the ejecting amount ranks is set as the ejecting amount rank. On the other hand, if the new suction amount rank Rb is greater than the minimum rank RMin, the process proceeds to step B11, the new ejecting amount rank Rb is set as it is. Based on the suction amount rank thus determined, the suction amount is selected, and the consumption of ink in the ink tank is calculated. Then, the ink consumption thus calculated is, as described above, added to the cumulative consumption consumed by the printing apparatus so far to update the cumulative consumption.

For example, when the obtained ejecting amount rank R is "Rank 1" and the environmental temperature is 9° C., the environmental temperature Te<the threshold value Teh1 (∵Teh1=10° C.), the rank correction value becomes "−1", and thus the new suction amount rank Rb=RankR+(−1)=1−1=0. Accordingly, since Rb<Rmin, it is set that the new suction amount rank Rb=1. Accordingly, when a suction mode A is performed, the correction value of the suction amount becomes 0.45 from the table of suction amount ranks of FIG. 11, and the consumption of ink in the ink tank is calculated by use of this correction amount.

Consequently, according to the inkjet printing apparatus of the present invention, the printing head temperature and the environmental temperature are obtained, so that the printing apparatus accurately recognizes the amount of ink consumed by a discharge and suction. Thereby, the ink is never wastefully disposed of, and the running cost of the printing apparatus can be lowered.

In the present embodiment, the correction value K has been provided, if THead<Th1, as K=−4, and if TH1<THead<Th2, as K=0, and if THead>Th2, as K=4, however, without limitation hereto, this may be appropriately changed to other values. In addition, the correction value L has been provided, if Te<Teh1, as L=−1, and if Teh1<Te<Teh2, as L=0, and if Te>Teh2, as L=1, however, without limitation hereto, this may be appropriately changed to other values.

Moreover, the correction values shown in FIG. 11 and FIG. 12 are also not limited hereto, and may be appropriately changed to other values.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-344633, filed Dec. 21, 2006, which is hereby incorporated by reference herein in its entirety.

What is claimed is:

1. An inkjet printing apparatus that performs printing by use of a printing head that ejects ink, comprising:

a sucking unit that performs a sucking operation to suck ink from the printing head;

an obtaining unit that obtains suction amount rank information indicating ranks of a suction amount depending on an individual difference among inkjet printing apparatuses, the suction amount rank information corresponding to a suction amount unique to said inkjet printing apparatus, and ejecting amount rank information indicating ranks of an ejecting amount depending on an individual difference among printing heads, the ejecting amount rank information corresponding to an ejecting amount unique to the printing head;

a consumption calculating unit that calculates a total consumption of ink consumed by the inkjet printing apparatus by a sum of a consumption of ink consumed in the sucking operation by the sucking unit, which is calculated based on suction amount rank information obtained by said obtaining unit, and a consumption of ink consumed in an ejecting operation by the printing head, which is calculated based on ejecting amount rank information obtained by said obtaining unit; and an environmental temperature measuring unit that measures an environmental temperature and a changing unit that changes the suction amount rank information based on an environmental temperature obtained by said environmental temperature measuring unit.

2. An inkjet printing apparatus that performs printing by use of a printing head that ejects ink, comprising:

a sucking unit that performs a sucking operation to suck ink from the printing head;

an obtaining unit that obtains suction amount rank information indicating ranks of a suction amount depending on an individual difference among inkjet printing apparatuses, the suction amount rank information corresponding to a suction amount unique to said inkjet printing apparatus, and ejecting amount rank information indicating ranks of an ejecting amount depending on an individual difference among printing heads, the ejecting amount rank information corresponding to an ejecting amount unique to the printing head;

a consumption calculating unit that calculates a total consumption of ink consumed by the inkjet printing apparatus by a sum of a consumption of ink consumed in the sucking operation by the sucking unit, which is calculated based on suction amount rank information obtained by said obtaining unit, and a consumption of ink consumed in an ejecting operation by the printing head, which is calculated based on ejecting amount rank information obtained by said obtaining unit; and a printing head temperature measuring unit that measures a temperature of the printing head and a changing unit that changes the ejecting amount rank information based on a printing head temperature obtained by said printing head temperature measuring unit.

* * * * *